United States Patent [19]

Ganster et al.

[11] 4,349,884

[45] Sep. 14, 1982

[54] FEEDSTOCK TEMPERATURE CONTROL SYSTEM

[75] Inventors: Charles A. Ganster, Houston; Gerald V. Nelson, Nederland, both of Tex.

[73] Assignee: Texaco Inc., White Plains, N.Y.

[21] Appl. No.: 216,724

[22] Filed: Dec. 15, 1980

[51] Int. Cl.[3] ..... C10G 21/00

[52] U.S. Cl. ..... 364/557; 364/501; 196/46; 422/62

[58] Field of Search ..... 364/557, 501; 196/46, 196/132; 422/62; 208/DIG. 1, 350; 203/DIG. 19, 1, 3

[56] References Cited

U.S. PATENT DOCUMENTS

| | | | |
|---|---|---|---|
| 4,092,847 | 6/1978 | Lynch et al. | 364/557 X |
| 4,230,215 | 10/1980 | Sequeira, Jr. et al. | 196/46 |
| 4,236,219 | 11/1980 | Killebrew et al. | 208/DIG. 1 X |
| 4,249,907 | 2/1981 | Callejas | 364/557 X |
| 4,262,791 | 4/1981 | Lynch et al. | 422/62 X |

*Primary Examiner*—Edward J. Wise
*Attorney, Agent, or Firm*—Carl G. Ries; Robert A. Kulason; Ronald G. Gillespie

[57] ABSTRACT

A control system controls the temperature of naphtha being charged to a reactor in a hydrotreating unit. The control system includes a heater which heats the naphtha in accordance with a control signal corresponding to a desired temperature. A gravity analyzer senses the API gravity of the naphtha and provides a corresponding signal. A sulfur analyzer senses the sulfur content of the naphtha and provides a representative signal. A boiling point analyzer senses the 50% boiling point temperature, the initial boiling point temperature and the end point temperature of the naphtha and provides corresponding signals. A flow rate sensor provides a signal corresponding to the flow rate of the naphtha entering the heater. A control signal circuit provides the control signal to the heater in accordance with the signals from the gravity analyzer, the sulfur analyzer, the boiling point analyzer and the flow rate sensor.

12 Claims, 12 Drawing Figures

FEEDSTOCK TEMPERATURE CONTROL SYSTEM

BACKGROUND OF THE INVENTION

Field of the Invention

The present invention relates to process control systems in general and, more particularly, to a process control system for a hydrotreating unit.

SUMMARY OF THE INVENTION

A control system controls the temperature of naphtha charged to a reactor in a hydrotreating unit. The control system includes a heater receiving the naphtha which heats the naphtha being provided to the reactor. Gravity, sulfur and boiling point analyzers sample the naphtha and provide signals corresponding to the API gravity of the naphtha, the sulfur content of the naphtha, the 50% boiling point temperature, the initial boiling point temperature and the end point temperature of the naptha. A flow rate sensor senses the flow rate of the naphtha and provides a corresponding signal. A network provides the control signal to the heater in accordance with the signals from the analyzers and the sensor.

The objects and advantages of the invention will appear more fully hereinafter, from a consideration of the detailed description which follows, taken together with the accompanying drawings, wherein one embodiment is illustrated by way of example. It is to be expressly understood, however, that the drawings are for illustrative purposes only and are not to be construed as defining the limits of the invention.

DESCRIPTION OF THE INVENTION

Figure 1:
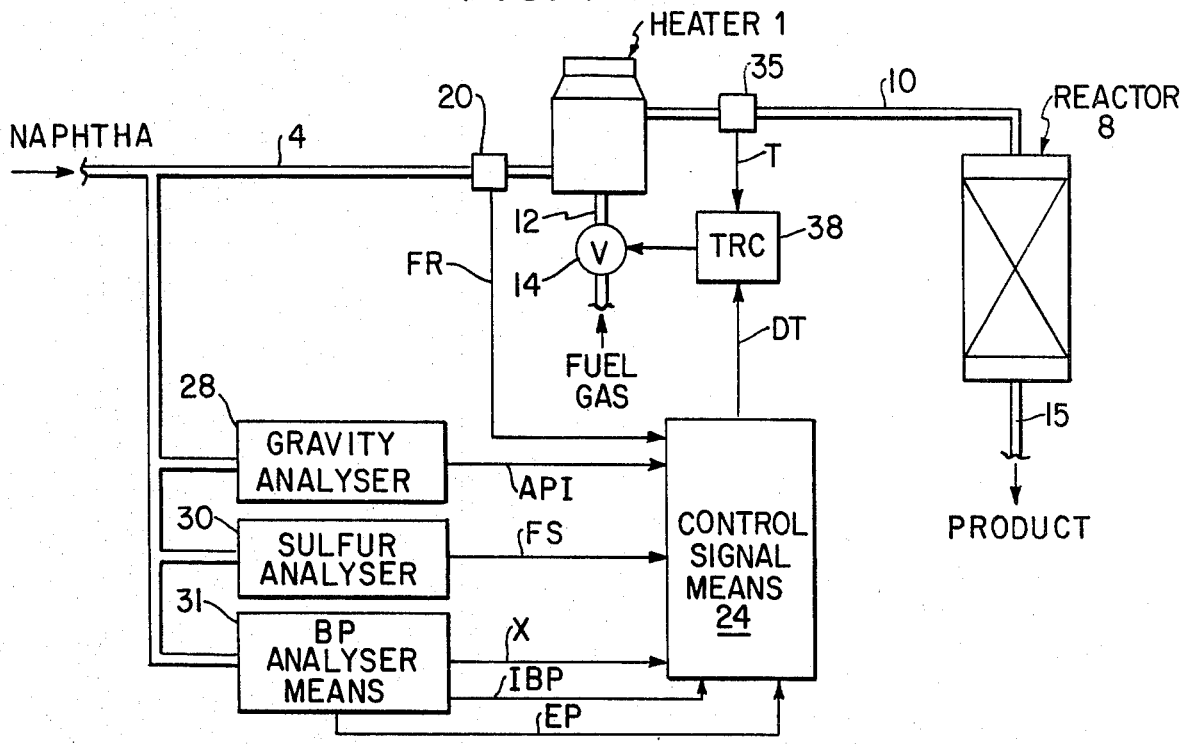
FIG. 1 shows a hydrotreating unit in schematic form and a simplified block diagram of a control system, constructed in accordance with the present invention, for controlling the temperature of naphtha charged to a reactor in the hydrotreating unit.

A control system controls the temperature of straight run naphtha stock charged to a reactor in a hydrotreating unit so as to control the sulfur content of the product provided by the unit using the following equations:

$$MW = e^{[C1+C2(X)+C3(API)-C4(X)^2+C5(X)(API)-C6(API)^2+C7(API)^2(X)^2-C8(X)^3]}, \quad 1.$$

where MW, API and X are the molecular weight, the API gravity and the 50% boiling point temperature in °F of the naphtha, respectively, entering the reactor, and C1 through C8 are constants having preferred values of 3.676093, 0.003125368, 0.00528224, $0.54547885\times10^{-6}$, $0.30253428\times10^{-5}$, $0.1813995\times10^{-4}$, $0.8078238\times10^{-10}$ and $0.1723476\times10^{-9}$, respectively.

$$SF = C9 - C10e^{-(C11)(X)} \quad 2.$$

where SF is a sulfur factor which is the distillation temperature at which half of the sulfur in the feedstock is distilled overhead, and C9 through C11 are constants having preferred values of 503.44, 76765 and 0.018726, respectively, $$R = EP - IBP \quad 3.$$

where R is the temperature range of the naphtha feedstock between its initial boiling point temperature (IBP) in °F. and its end point temperature in °F. All boiling points referred to in the application are true boiling point temperatures.

$$A = \{(SF) + [(API)^{C12}(FS)(R)]/(MW)\}[C13/R]^{C14} \quad 4.$$

where A is a feedstock correlating parameter, FS is the weight per cent sulfur in the feedstock, and C12, C13 and C14 are constants having a preferred value of 1.1, 100 and 0.05, respectively.

$$CT = C15(A) + C16 \quad 5.$$

where CT is a correction temperature for desulfurization, C15 and C16 are constants and have preferred values of 0.62 and 269, respectively, for 95% desulfurization and of 0.6067 and 257, respectively, for 90% desulfurization.

$$K = (C17)(PLHSV)[1/\sqrt{SPS} - 1/\sqrt{FS}] \quad 6.$$

where K is a reaction rate constant, PLHSV is a predetermined value for the liquid hourly space velocity based on past experience with a particular unit, SPS is a product sulfur in weight percent and will be either 5% or 10% of the feedstock sulfur for 95% or 90% desulfurization, respectively, and C17 is a constant having a preferred value of 2.

$$RT = C18/(CT + C19) \quad 7.$$

where RT is reciprocal temperatures and C18 and C19 are constants having preferred values of $10^4$ and 460, respectively.

$$m = (\ln K95 - \ln K90)/(RT95 - RT90) \quad 8.$$

where m is the slope of a straight line approximating the kinetic relationship between the reaction rate constant and the reciprocal temperatures, K95 and K90 are the reaction rate constants for 95% and 90% desulfurization, and RT95 and RT90 are the reciprocal temperatures for 95% and 90% desulfurization, respectively.

$$b = \ln K95 - RT95(m) \quad 9.$$

where b is the intercept of the straight line.

$$ALHSV = (FR)/(VC) \quad 10.$$

where ALHSV is the actual liquid hourly space velocity, FR is the flow rate of the naphtha in barrels per hour, and VC is the volume of catalyst in barrels.

$$Z=(C17)(ALHSV)(1/\sqrt{DPS}-1/\sqrt{FS}) \quad 11.$$

where Z is the reaction rate constant for a desired product sulfur content DPS.

An equation for the desired temperature DT is derived from equation 7, and the straight line; by substituting DT for CT and rewriting as:

$$DT=[(m)(C18)+(b)(C19)-(C19)(\ln Z)]/(\ln Z-b). \quad 12.$$

Referring now to FIG. 1, a hydrotreating unit includes a heater 1 receiving straight run naphtha feedstock through a line 4, which heats the feedstock as hereinafter explained and provides the heated feedstock to a reactor 8 through a line 10. Heater 1 receives fuel gas through a line 12 having a valve 14. Reactor 8 provides a product through a line 15.

A control system controls the temperature of the feedstock being provided to reactor 8 to control the sulfur content of the product. In this regard, a conventional type flow transmitter 20 located in line 4 senses the flow rate of the feedstock and provides a signal FR to control signal means 24. A gravity analyzer 28 and a sulfur analyzer 30 sample the feedstock and provides signals API and FS, respectively, corresponding to the API gravity and the sulfur content, percent by weight, of the feedstock to control signal means 24. Boiling point analyzer means 31 samples the feedstock and provides signals X, IBP and EP to control signal means 24 corresponding to the 50% boiling point temperature, the initial boiling point temperature and the end point temperature, respectively. A temperature sensor 35 senses the temperature of the heated feedstock in line 10 and provides a signal T, corresponding to the sensed temperature, to a temperature recorder controller 38. Temperature recorder controller 38 also receives a signal DT from control signal means 24, corresponding to a desired temperature, and controls valve 14 in accordance with the difference between signals T and DT to control the temperature of the heated feedstock in line 10.

Figure 2:
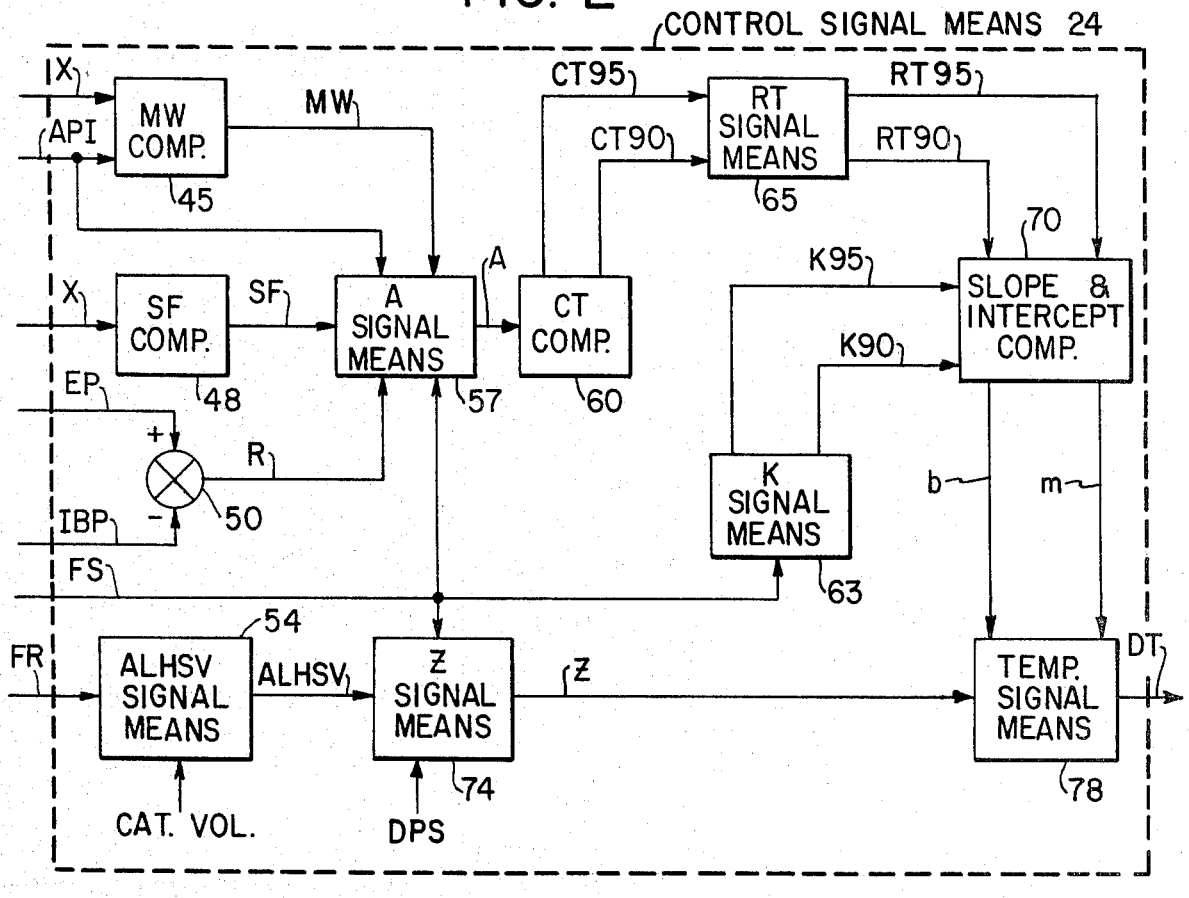
FIG. 2 is a simplified block diagram of the control signal means shown in FIG. 1.

Referring now to FIG. 2, control signal means 24 includes an MW computer 45 receiving signals X and API and providing a signal MW in accordance with signals X and API and equation 1. An SF computer 48 receives signal X and provides signal SF in accordance with equation 2.

Subtracting means 50 subtracts signal IBP from signal EP to provide a signal R corresponding to the temperature range in accordance with equation 3. ALHSV signal means 54 receives signal FR and a direct current voltage CAT.VOL., and provides a signal ALHSV in accordance with the received signals and equation 10. A signal means 57 receives signals MW, API, SF, R and FS and provides signal A in accordance with equation 4 to a CT computer 60. CT computer 60 provides signals CT90 and CT95 to RT signal means 65 in accordance with equation 5.

K signal means 63 receives signal FS and provides signal K95 and K90 in accordance with equation 6. RT signal means 65 provides signals RT95 and RT90 in accordance with equation 7. A slope and intercept computer 70 receives signals K90, K95, RT90 and RT95 and provides signals m and b corresponding to the slope and the intercept of a straight line approximating the kinetic relationship between the reaction rate constants and the reciprocal temperatures in accordance with equations 8 and 9. A Z signal means 74 receives signals ALHSV and FS and a direct current voltage DPS and provides signal Z corresponding to the reaction rate constant at a desired product sulfur level in accordance with equation 11. Temperature signal means 78 receives signals Z, b and m and provides signal DT in accordance with equation 12.

Figure 3:
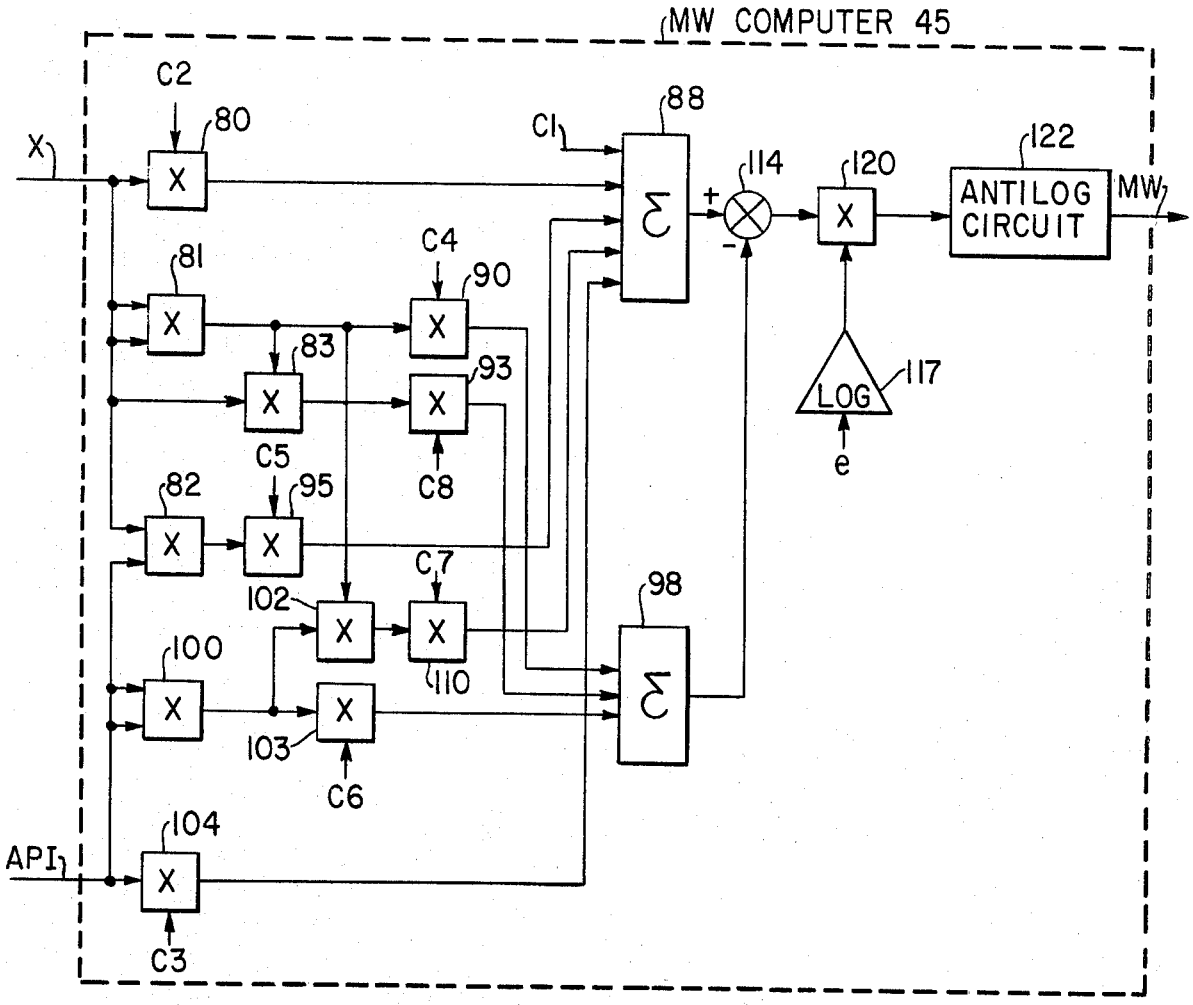
FIGS. 3, 4, 5, 6, 7, 8, 9, 10, 11 and 12 are detailed block diagrams of the MW computer, the SF computer, the ALHSV signal means, the A signal means, the CT computer, the K signal means, the RT signal means, the slope and intercept computer, the Z signal means and the temperature signal means, respectively, shown in FIG. 2.

Referring to FIG. 3, MW computer 45 includes a multiplier 80 which multiplies signal X with a direct current voltage C2 to provide a product signal to summing means 88. A multiplier 81 effectively squares signal X to provide a signal to multipliers 83 and 90. Multiplier 83 multiplies the product signal of multiplier 81 with signal X to provide a signal corresponding to $X^3$ to another multiplier 93. Multiplier 82 multiplies signals X and API to provide a product signal which is multiplied with a direct current voltage C5 by a multiplier 95.

Multipliers 90 and 93 multiply the product signals from multipliers 81 and 83, respectively, with direct current voltages C4 and C8, respectively, to provide product signals to summing means 98. A multiplier 100 effectively squares signal API and provides a product signal to multipliers 102 and 103, while yet another multiplier 104 multiplies signal API with a direct current voltage C3 to provide a product signal to summing means 88. Multiplier 103 multiplies a signal provided by multiplier 100 with direct current voltage C6 to provide a signal to summing means 98. Multiplier 102 multiplies the product signal from multiplier 100 with the product signal from multiplier 81 to provide a product signal which is multiplied with a direct current voltage C7 by a multiplier 110 which provides a corresponding product signal. Summing means 88 effectively sums the positive terms of equation 1 when it sums a direct current voltage C1 with the product signals from multipliers 80, 95, 104 and 110, to provide a corresponding sum signal. Summing means 98 in effect sums all the negative terms of equation 1 when it sums the product signals from multipliers 90, 93 and 103, to provide a signal which is subtracted from the sum signal provided by summing means 88 by subtracting means 114.

A direct current voltage e corresponding to the mathematical constant e is provided to a logarithmic amplifier 117 which provides a signal to a multiplier 120 where it is multiplied with the difference signal provided by subtracting means 114. The product signal provided by multiplier 120 is applied to an antilog circuit 122 which provides signal MW.

Figure 4:
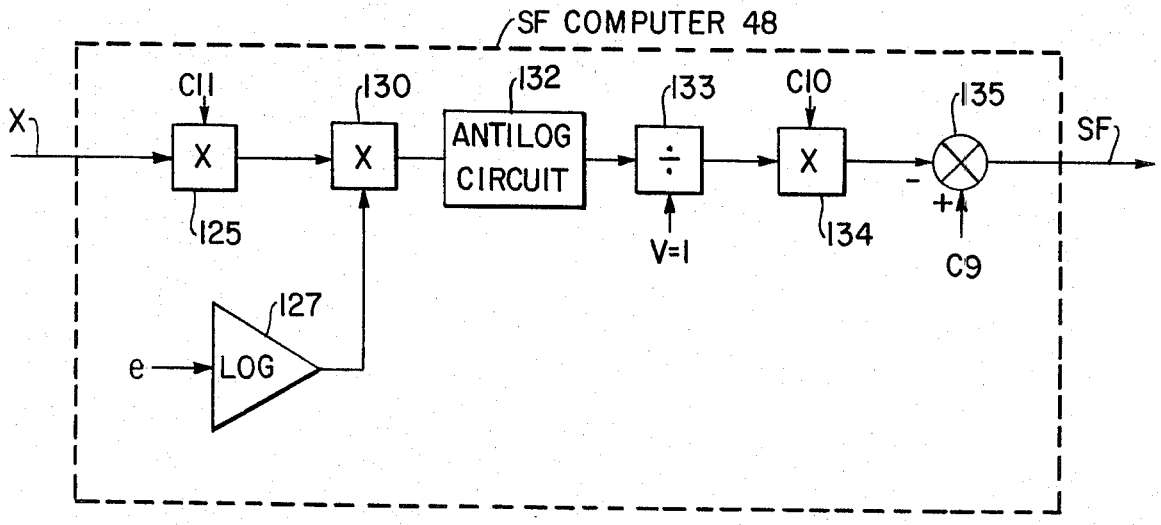

A multiplier 125 in SF computer 48, shown in FIG. 4, multiplies signal X with the direct current voltage C11, to provide a product signal. The DC voltage e is applied to a logarithmic amplifier 127 and the resultant signal is multiplied with the product signal from multiplier 125 by another multiplier 130. The product signal from multiplier 130 is applied to an antilog circuit 132 which provides a corresponding signal to a divider 133. Divider 133 divides a direct current voltage corresponding to a value of 1 with the signal from circuit 132 to provide a signal corresponding to the term $e^{-(C11)(X)}$ in equation 2. Divider 133 is multiplied with a direct current voltage C10 by a multiplier 134 and its product signal is subtracted from a direct current voltage C9 by subtracting means 135 to provide signal SF.

Figure 5:
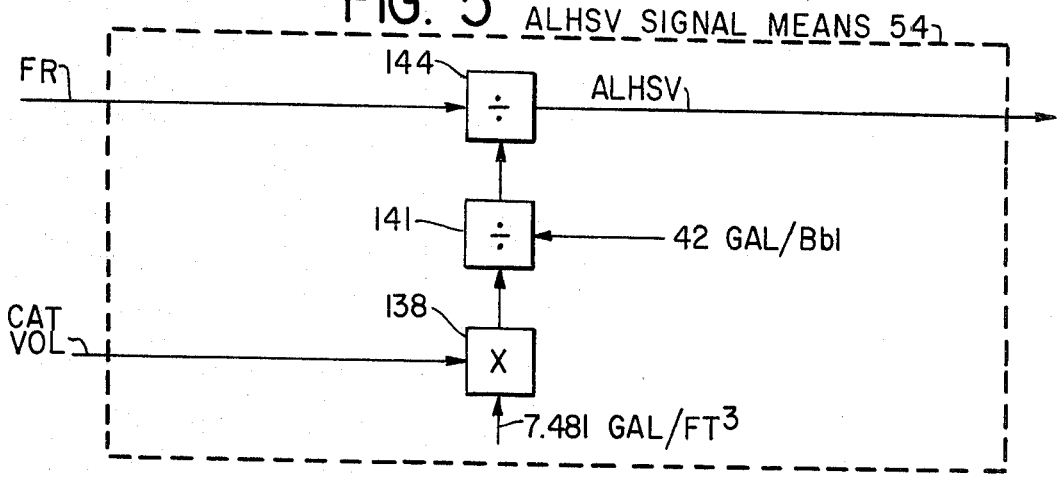

Referring now to FIG. 5, there is shown a multiplier 138 and a divider 141 in ALHSV signal means 54 which converts the catalyst volume that is in cubic feet into barrels. If the catalyst volume is known in the form of barrels, then elements 138, 141 may be omitted. A direct current voltage CAT.VOL. is applied to multiplier 138 where it is multiplied with a direct current voltage corresponding to the constant 7.481 gallons per foot$^3$. The resultant product signal is divided by another direct current voltage corresponding to a constant of 42 gallons per barrel by divider 141 to provide a signal VC corresponding to the catalyst volume in barrels. Divider 144 performs the function of equation 10 by dividing signal FR with the signal from divider 141 to provide signal ALHSV.

Figure 6:
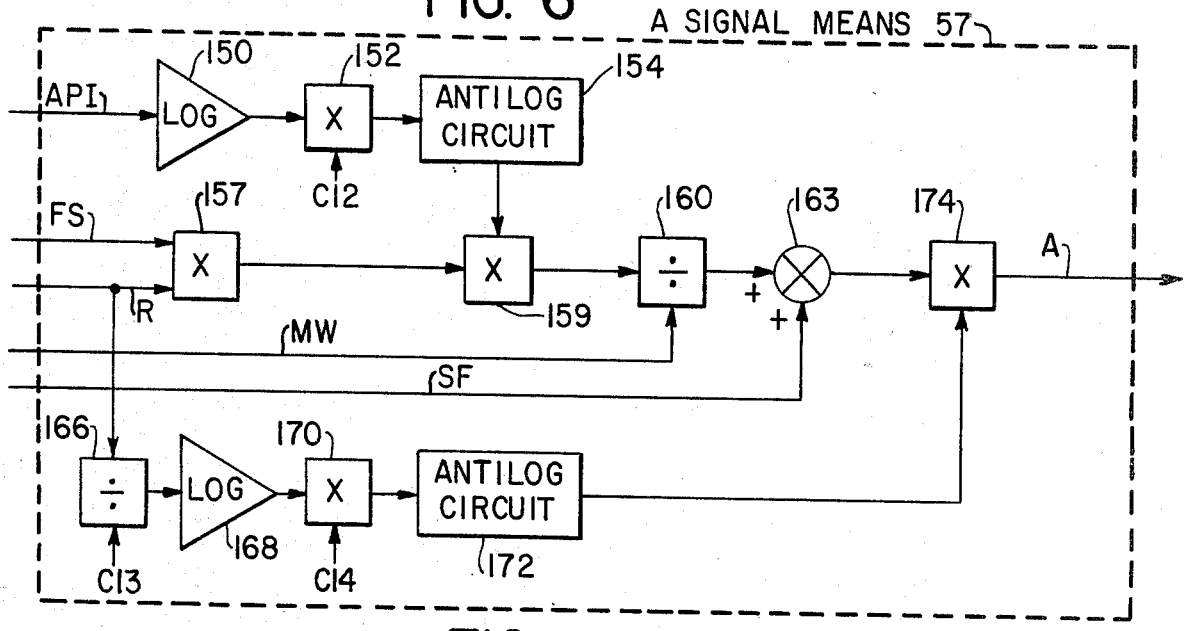

A signal means 57, shown in FIG. 6, includes a logarithmic amplifier 150 receiving signal API and providing a signal which is multiplied with a direct current voltage C12 by a multiplier 152. A product signal provided by multiplier 152 is applied to an antilog circuit 154 which provides a signal corresponding to the term $(API)^{(C12)}$ in equation 4. A multiplier 157 multiplies signals FS and R to provide a product signal which is multiplied with the signal provided by antilog circuit 154 by a multiplier 159. A divider 160 divides the signal provided by multiplier 159 with signal MW to provide a corresponding signal. Summing means 163 sums the signal provided by divider 160 with signal SF. A divider 166 divides a direct current voltage C13 with signal R to provide a signal to a logarithmic amplifier 168. A signal provided by logarithmic amplifier 168 is multiplied with a direct current voltage C14 by a multiplier 170 to provide a corresponding signal to an antilog circuit 172. A multiplier 174 multiplies the sum signal from summing means 163 with the signal from antilog circuit 172 to provide signal A.

Figure 7:
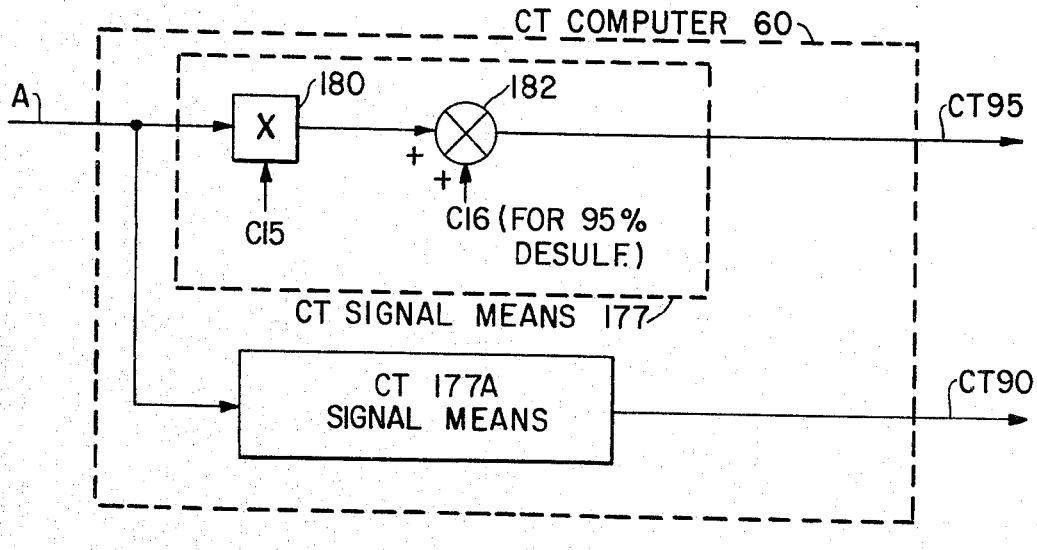

Referring now to FIG. 7, CT computer 60 includes CT signal means 177 receiving signal A and providing signal CT95 corresponding to the value for CT for 95% desulfurization. CT signal means 177 includes a multiplier 180. Multiplier 180 multiplies signal A with a direct current voltage C15 to provide a signal which is summed with another direct current voltage C16 by summing means 182 to provide signal CT95. Similarly, CT signal means 177A receives signal A and provides signal CT90. The difference between signal means 177A and signal means 177 lies in the voltage level for direct current voltages C15 and C16. Signal CT90 corresponds to the CT parameter for 90% desulfurization.

Figure 8:
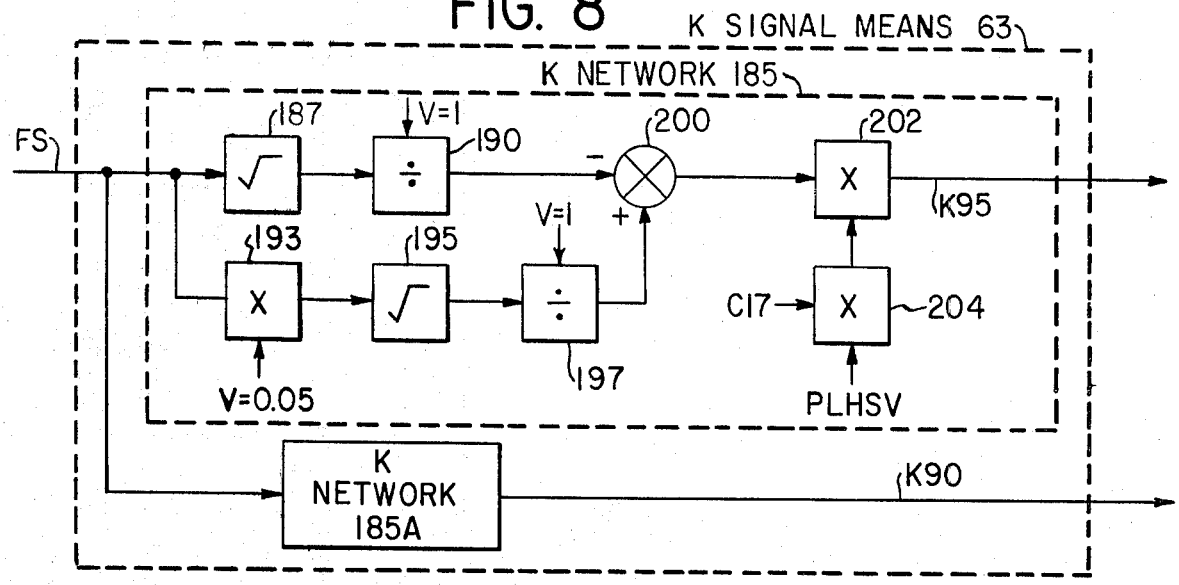

Referring now to FIG. 8, k signal means 63 includes a K network 185 which has a square root circuit 187 providing a signal corresponding to the square root of FS in equation 6 in accordance with signal FS. The signal from square root circuit 187 is divided into a direct current voltage corresponding to a value of 1 by a divider 190. Signal FS is also supplied to multiplier 193 where it is multiplied by a direct current voltage corresponding to 0.05 to give a signal equivalent to the weight percent sulfur which would remain in the naphtha if 95% desulfurization were being obtained. The resulting signal is applied to square root circuit 195 which provides a signal which is divided into a direct current voltage corresponding to a value of 1 by a divider 197. Subtracting means 200 subtracts the signal provided by divider 190 from the signal provided by divider 197 to provide a signal to a multiplier 202. Another multiplier 204 multiplies a direct current voltage PLHSV corresponding to the predetermined liquid hourly space velocity with the direct voltage C17 to provide a signal which is multiplied with the signal from subtracting means 200 by multiplier 202 which provides signal K95. K network 185A is identical to K network 185 except that the value of the direct current voltage applied to multiplier 193 is 0.1 instead of 0.05 so that K network 185A provides signal K90 corresponding to the value for K for 90% desulfurization.

Figure 9:
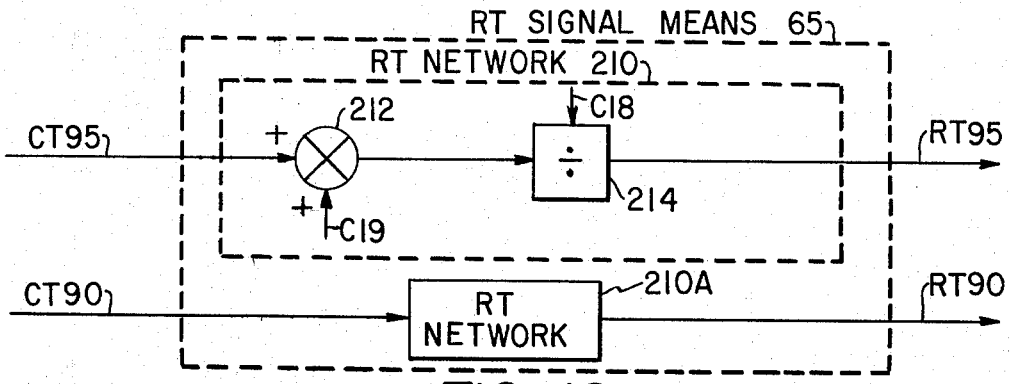

Referring now to FIG. 9, RT signal means 65 includes an RT network 210 which consists of summing means 212 which sums signal CT95 with a direct current voltage C19 to provide a signal corresponding to the term (CT+C19) in equation 7. A divider 214 divides a direct current voltage C18 with the signal provided by summing means 212 to provide signal RT95. Similarly, RT network 210A provides signal RT90 in accordance with signal CT90.

Figure 10:
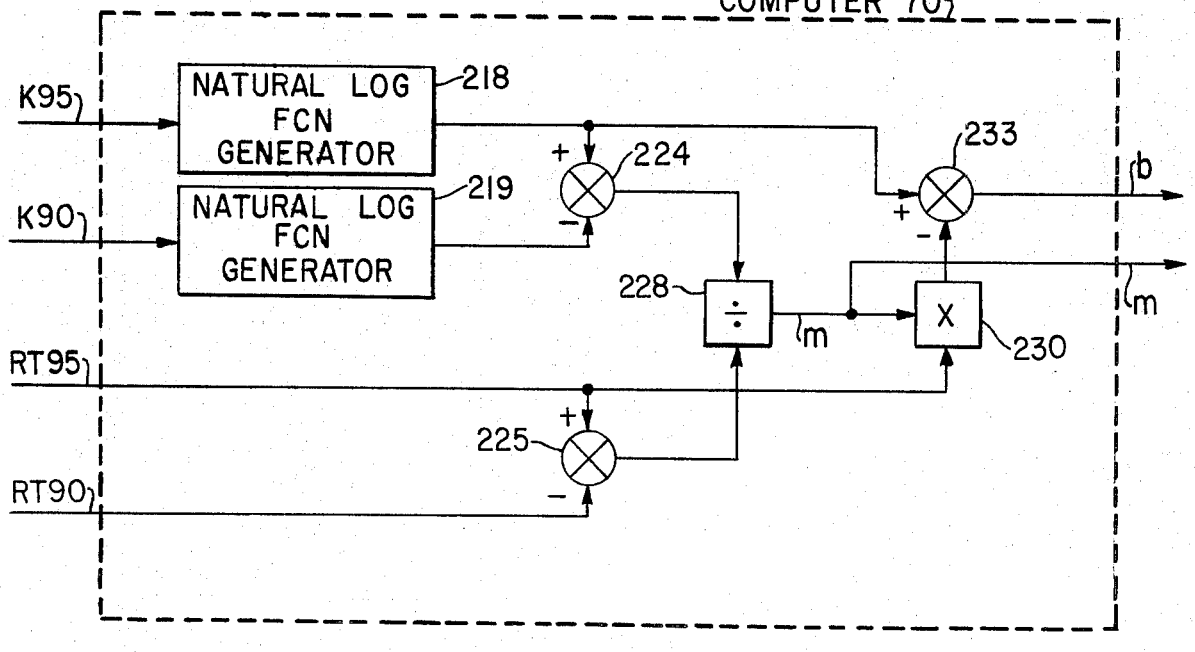

Referring now to FIG. 10, slope and intercept computer 70 includes natural log function generators 218 and 219 which receive signals K95 and K90 and provide signals corresponding to the natural logs of those signals. Subtracting means 224 and 225 subtract the signal provided by natural log function generators 219 and signal RT90, respectively, from the signal provided by natural log function generator 218 and signal RT95, respectively, to provide difference signals to a divider 228. Divider 228 divides the signal provided by subtracting means 225 into the signal provided by subtracting means 224 to provide signal m corresponding to the term m in equation 8. Signal m is multiplied with signal RT95 by a multiplier 230 to provide a product signal which is subtracted from the signal provided by function generator 218 by subtracting means 233 which provides signal b corresponding to the term b in equation 9.

Figure 11:
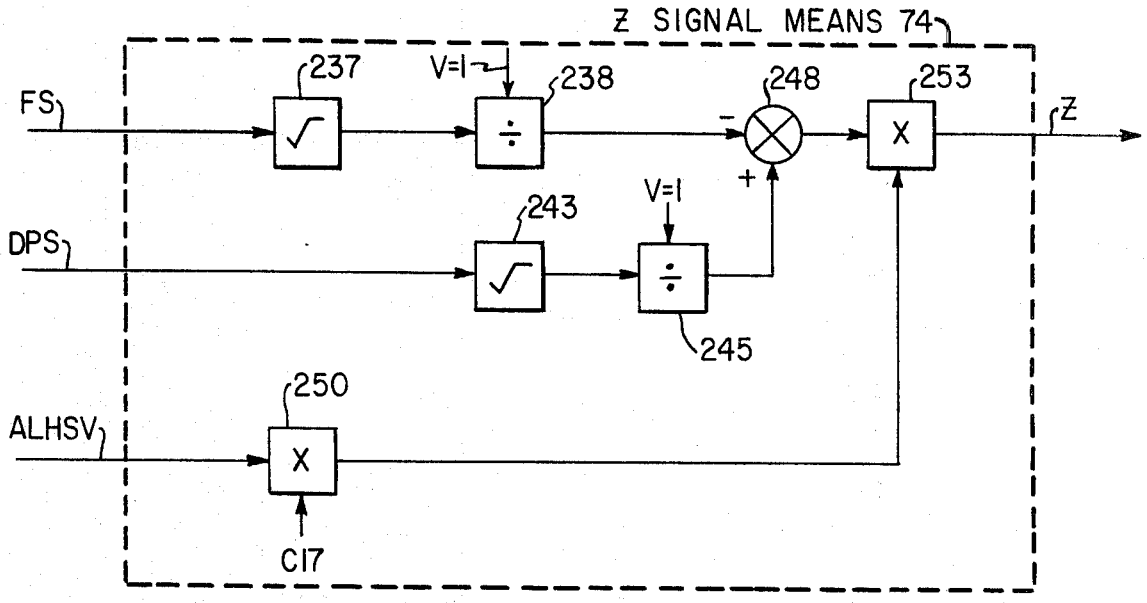

Z signal means 74 shown in FIG. 11 includes a square root circuit 237, receiving signal FS and providing a signal corresponding to square root of signal FS. A divider 238 divides a direct current voltage corresponding to the value of 1 with the signal provided by square root circuit 237. A square root circuit 243 receives a direct current voltage DPS corresponding to the specified percent by weight sulfur in the product and provides a signal corresponding to the square root of voltage DPS to a divider 245. Divider 245 divides the signal from the square root circuit 243 into the direct current voltage corresponding to the value of 1 to provide a signal which has the signal from divider 238 subtracted from it by subtracting means 248. A multiplier 250 multiplies signal ALHSV with a direct current voltage C17 to provide a signal which is multiplied with the difference signal from subtracting means 248 by a multiplier 253 to provide signal Z.

Figure 12:
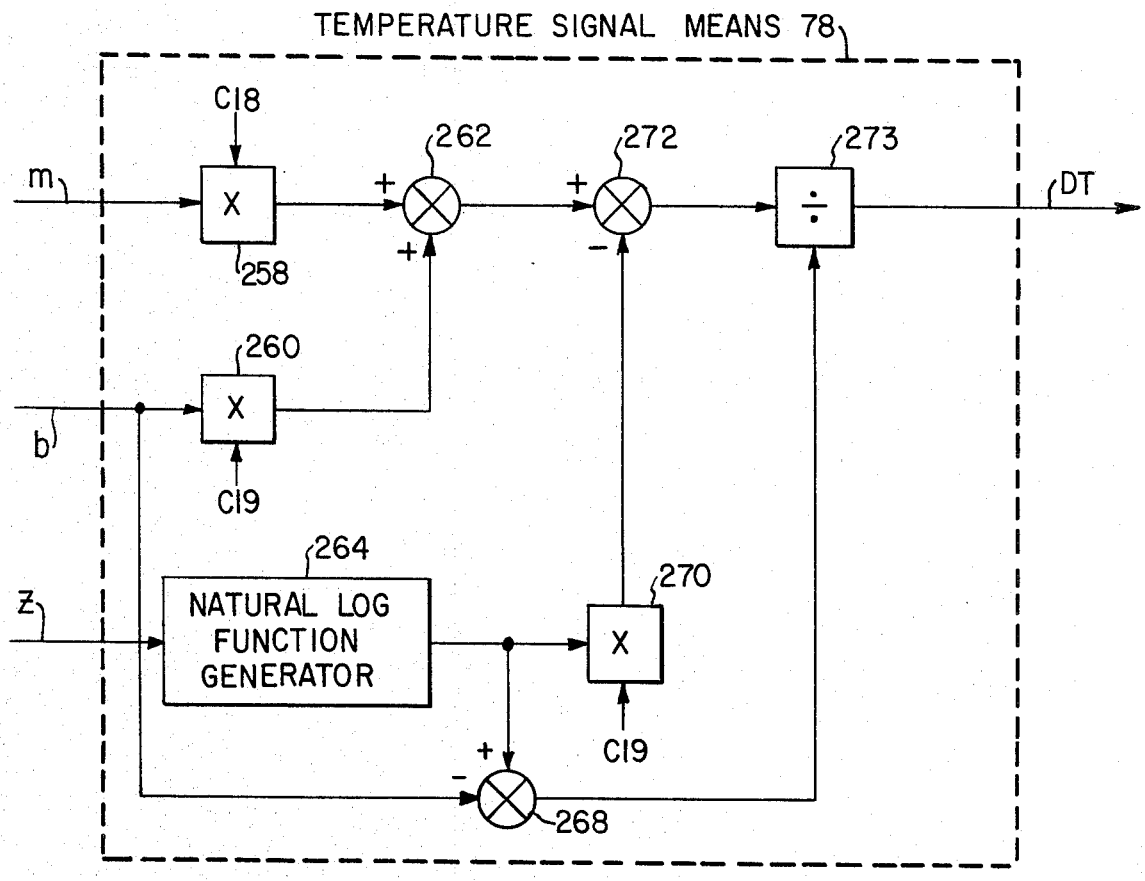

Referring now to FIG. 12, temperature signal means 78 includes multipliers 258 and 260 multiplying signals m and b, respectively, with direct current voltages C18 and C19, respectively, to provide corresponding product signals which are summed by summing means 262. A natural log function generator 264 provides a signal corresponding to the natural log of signal Z which has signal b subtracted from it by subtracting means 268 and which is multiplied with voltage C19 by a multiplier 270. The product signal provided by multiplier 270 is subtracted from the signal provided by summing means 262 by subtracting means 272 to provide a signal which is divided by the signal from subtracting means 268 by a divider 273. Divider 273 provides signal DT.

It should be noted in the foregoing description, that direct current voltages identified as C with a numeric designation corresponds to the constants in the equations having the numeric designations. It also should be noted that the present invention may also be practiced by one skilled in the art using a specially programmed general purpose digital computer in cooperation with the appropriate sensors, analyzers and control devices utilizing conventional analog-to-digital and digital-to-analog converters as necessary, so that the present invention is not restricted to use of an analog computer.

What is claimed is:

1. A control system for controlling the temperature of naphtha being fed to a reactor in a hydrotreating unit comprising heater means receiving the naphtha for heating the naphtha in accordance with a control signal DT corresponding to a desired temperature for the naphtha entering the reactor and providing the heated naphtha to the reactor, gravity analyzer means for sensing the API gravity of the naphtha and providing a signal API corresponding thereto, sulfur analyzer means for sensing the sulfur content of the naphtha and providing a corresponding signal FS, boiling point analyzer means for sensing the 50% boiling point temperature, the initial boiling point temperature and the end point temperature of the naphtha and providing corresponding signals X, IBP and EP, respectively, flow rate means for sensing the flow rate of the naphtha and providing a signal FR representative thereof, and control signal means connected to the heater means, to the gravity analyzer means, to the sulfur analyzer means, to the boiling point analyzer means and to the flow rate means for providing control signal DT in accordance with signals API, FS, X, IBP, EP and FR.

2. A control system as described in claim 1 in which the control signal means includes means connected to the boiling point analyzer means and to the gravity analyzer means for providing a signal MW corresponding to the molecular weight of the naphtha in accordance with signals X and API, SF computer means connected to the boiling point analyzer means for providing a signal SF corresponding to a sulfur factor which is at the estimated distillation temperature at which half of the sulfur in the feedstock is distilled overhead, subtracting means connected to the boiling point analyzer means for subtracting signal IBP from signal EP to provide signal R corresponding to the temperature range of the naphtha, ALHSV signal means connected to the flow rate means and receiving a direct current voltage CAT.VOL. corresponding to the catalyst volume of the reactor in barrels for providing a signal ALHSV corresponding to the actual liquid hourly space velocity in accordance with signal FR and the voltage CAT VOL, A signal means connected to the MW computer means, to the SF computer means, to the subtracting means, to the sulfur analyzer means and to the gravity analyzer means for providing a signal A corresponding to a feedstock correlating parameter in accordance with signals MW, SF, R, FS and API, CT signal means connected to the A signal means for providing signals CT95 and CT90, corresponding to the correction temperature for 95% desulfurization and 90% desulfurization, respectively, RT signal means connected to the CT signal means for providing signals RT95 and RT90 corresponding to the reciprocal temperatures for 95% desulfurization and 90% desulfurization, respectively, in accordance with signals CT95 and CT90, K signal means connected to the sulfur analyzer means for providing signals K95 and K90 corresponding to reaction rate constants for 95% desulfurization and 90% desulfurization, respectively, in accordance with signal FS, slope and intercept signal means connected to the RT signal means and to the K signal means for providing signals m and b corresponding to the slope and intercept, respectively, of a straight line approximating the kinetic relationship between the reaction rate constant and the reciprocal temperatures in accordance with signals RT95, RT90, K95 and K90, Z signal means connected to the ALHSV signal means, to the sulfur analyzer means and receiving a direct current voltage DPS corresponding to the desired product sulfur content of the product for providing a signal Z corresponding to a reaction rate constant and FS and voltage DPS, in accordance with signals ALHSV, and temperature signal means connected to the slope and intercept computer means and to the Z signal means for providing signal DT in accordance with signals m, b, and Z.

3. A control system as described in claim 2 in which the MW computer means includes MW signal means receiving direct current voltages corresponding to terms C1 through C8 and e, signals X and API for providing signal MW in accordance with the received signals and voltages and the following equation:

$$MW = e^{[C1+C2(X)+C3(API)-C4(X)2+C5(X)(API)-C6(API)2+C7(API)2(X)2-C8(X)3]},$$

where C1 through C8 are constants.

4. A control system as described in claim 3 in which the SF signal means includes SF computer means connected to the boiling point analyzer means and receiving direct current voltages corresponding to a value of 1 and to terms C9 through C11 and e for providing signal SF in accordance with signal X, the received voltages and the following equation:

$$SF=C9-C10e^{-C11(X)},$$

where C9 through C11 are constants.

5. A control system as described in claim 4 in which the ALFSV signal means also receives a direct current voltage VC corresponding to the volume of the catalyst in the reactor in barrels and provides signal ALHSV in accordance with signal FR, a direct current voltage VC corresponding to the volume of catalyst in the reactor in accordance with the following equation:

$$ALHSV=(FR)/(VC).$$

6. A control system as described in claim 5 in which the A signal means also receives direct current voltages corresponding to terms C12 through C14 and provides signal A in accordance with signals SF, API, FS, R and MW, the received voltages and the following equation:

$$A=\{(SF)+[(API)^{C12}(FS)(R)]/(MW)\}[C13/R]^{C14}$$

where C12 through C14 are constants.

7. A control system as described in claim 6 in which the CT computer means includes CT95 signal means connected to the A signal means and receiving direct current voltages corresponding to constant C15 and C16 for 95% desulfurization for providing signal CT95 in accordance with signal A, direct current voltages and the following equation:

$$CT = C15(A) + C16,$$

where C15 and C16 are constants for 95% desulfurization, and CT90 signal means connected to the A signal means and receiving direct current voltages corresponding to constants C15 and C16 for 90% desulfurization for providing signal CT90 in accordance with signal A and received voltages in accordance with the following equation:

$$CT = C15(A) + C16,$$

where C15 and C16 are constants for 90% desulfurization.

8. A control system as described in claim 7 in which the K signal means includes K95 signal means connected to the sulfur analyzer and receiving direct current voltages corresponding to a value of 1, to a constant C17 for 95% desulfurization, to a value 0.05, and PLHSV representative of a predetermined value for the liquid hourly space velocity for the hydrotreating unit and providing signal K95 in accordance with signal FS, the received voltages and the following equation:

$$K95 = (C17)(PLHSV)[(1/\sqrt{0.05\ FS}) - (1/\sqrt{FS})]$$

and K90 signal means connected to the sulfur analyzer and receiving direct current voltages corresponding to a value of 1, to a constant C17 for 90% desulfurization, to PLHSV and to a value of 0.10 for providing a signal K90 in accordance with signal FS, the received voltages and the following equation:

$$K90 = (C17)\ (PLHSV)[(1/\sqrt{0.10\ FS}) - (1/\sqrt{FS})]$$

9. A control system as described in claim 8 in which the RT signal means includes RT95 signal means connected to the CT95 signal means and receiving direct current voltages corresponding to terms C18 and C19 for providing signal RT95 in accordance with signal CT95, the received voltages and the following equation:

$$RT95 = C18/(CT95 + C19)$$

where C18 and C19 are constants, and RT90 signal means connected to the CT90 signal means and receiving the direct current voltages corresponding to terms C18 and C19 for providing signal RT90 in accordance with signal CT90, the received voltages and the following equation:

$$RT90 = C18/(CT90 + C19).$$

10. A control system as described in claim 9 in which the slope and intercept signal means provides signals m and b in accordance with the following equations:

$$m = (\ln K95 - \ln K90)/(RT95 - RT90),$$

and $$b = \ln K95 - RT95\ (m).$$

11. A control system as described in claim 10 in which the Z signal means also receives direct current voltages corresponding to a value of 1 and to SPS and provides signal Z in accordance with signals FS and ALHSV, the received voltages and the following equation:

$$Z = (C17)(ALHSV)(1/\sqrt{DPS} - 1/\sqrt{FS}),$$

where C17 is a constant having a value associated with a desired specified product sulfur content.

12. A control system as described in claim 11 in which the temperature signal means receives direct current voltages C18 and C19 and provides signal DT in accordance with signal m, b and Z, the received voltages and the following equation:

$$DT = [(m)(C18) + (b)(C19) - (C19)(\ln Z)]/(\ln Z - b),$$

where C18 and C19 are constants.

* * * * *